US008814593B2

(12) United States Patent
Decrock et al.

(10) Patent No.: US 8,814,593 B2
(45) Date of Patent: Aug. 26, 2014

(54) CONNECTING ELEMENT FOR DATA LINES

(75) Inventors: Lieven Decrock, Roeslare (BE); Rutger Wilhelmus Smink, Hamont-Achel (BE)

(73) Assignees: Tyco Electronics Belgium EC BVBA, Oostkamp (BE); TE Connectivity Nederland B.V., 'S-Hertogenbosch (NL)

( * ) Notice: Subject to any disclaimer, the term of this patent is extended or adjusted under 35 U.S.C. 154(b) by 120 days.

(21) Appl. No.: 13/530,862

(22) Filed: Jun. 22, 2012

(65) Prior Publication Data

US 2013/0005183 A1 Jan. 3, 2013

(30) Foreign Application Priority Data

Jun. 29, 2011 (EP) ..... 11171933

(51) Int. Cl.
*H01R 13/648* (2006.01)

(52) U.S. Cl.
USPC ..... 439/607.01; 439/607.04; 439/794

(58) Field of Classification Search
USPC ..... 439/607.01, 820, 607.41, 794, 790; 307/147; 455/7
See application file for complete search history.

(56) References Cited

U.S. PATENT DOCUMENTS

| | | | | |
|---|---|---|---|---|
| 5,415,558 | A * | 5/1995 | Baker | 439/210 |
| 5,626,483 | A | 5/1997 | Naitoh | |
| 7,335,066 | B2 * | 2/2008 | Carroll et al. | 439/676 |
| 7,435,132 | B1 | 10/2008 | Fong et al. | |
| 8,152,558 | B2 * | 4/2012 | Broeksteeg et al. | 439/378 |
| 2004/0214479 | A1 * | 10/2004 | Bartok | 439/790 |
| 2007/0161296 | A1 | 7/2007 | Carroll et al. | |
| 2010/0233891 | A1 * | 9/2010 | Broeksteeg et al. | 439/63 |
| 2013/0002046 | A1 * | 1/2013 | Decrock et al. | 307/147 |

FOREIGN PATENT DOCUMENTS

| | | |
|---|---|---|
| EP | 2061121 A1 | 5/2009 |
| WO | WO 92/17922 | 10/1992 |

OTHER PUBLICATIONS

European Search Report issued by the European Patent Office—The Hague, dated Oct. 19, 2011, for European Patent Application No. EP 11171933.2; 6 pages.

* cited by examiner

*Primary Examiner* — Hae Moon Hyeon
(74) *Attorney, Agent, or Firm* — Faegre Baker Daniels LLP

(57) ABSTRACT

Connecting element for data lines with a body with a receiving section with recesses for receiving wires of the data lines, whereby electrical conductors are disposed on the body, whereby the conductors are guided from the recesses to a contact area, whereby the electronic circuit is connected with the conductors, whereby the element is made of molded material.

37 Claims, 5 Drawing Sheets

CONNECTING ELEMENT FOR DATA LINES

BACKGROUND OF THE INVENTION

1. Field of Invention

The invention refers to a connecting element for data lines.

In the field of data transmission cables, in particular high-speed applications, there is a desire to achieve cheap and reliable connecting elements for data lines. In the prior art, it is well-known to use repeat apparatuses for amplifying signals which are transmitted over electrical lines. The repeater apparatuses are electrically connected to data lines that transmit the data signals from and to the repeater apparatuses.

2. Related Art to the Invention

The known apparatuses are usually provided in the form of a stand-alone box, which is connected to the various cables in order to achieve the desired amplification and equalization of the signals. The data lines are connected with plugs that are fixed to the repeater apparatus.

SUMMARY OF INVENTION

The object of the invention is to provide an improved connecting element for data lines that provides a better connecting function to data lines.

The object of the invention is attained by a connecting element with a receiving section for receiving wires of the data lines, whereby the connecting element is made of molded material.

Because of the molded material the shape of the connecting element can be formed as it is useful for receiving data lines and fixing data lines at the connecting element.

The connecting element comprises recesses for receiving the data lines. The recesses improve the guiding of the data lines and improve a fixing of the data lines and improve the electrical connection between the wires of the data lines and the conductors that are disposed on the connecting element.

Further embodiments of the invention are described in the dependent claims.

The recesses are arranged in a shape corresponding to an arrangement of data lines in a cable, preferably in a circular arrangement that provides more space for connecting several data lines to the connecting element.

In a further embodiment, the wires of the data lines are arranged in the recesses and electrically connected with the conductors, whereby an electronic circuit is disposed in the contact area on the connecting element. This embodiment improves a simple and reliable electrical connection between a wire of a data line and the conductors.

In a further embodiment the receiving section has a circular shape perpendicular to a longitudinal axis of the element. The circular shape improves the suitability of the connecting element for being fixed to several data lines of a cable, whereby the cable may also have a circular cross section.

In a further embodiment, the receiving section is connected with a plate section, whereby the plate section is arranged along the longitudinal axis of the connecting element. The conductors are guided from the receiving section to the plate section. The plate section has the advantage that it can be used as a connector interface or it can be used as a carrier plate for an electrical or electronic circuit. Thus it is easily possible to connect several wires of a data line in a circular arrangement to the connecting element and to provide by the plate section a connector interface or a carrier for an electrical or electronic circuit.

In a further embodiment, the plate section is arranged between two opposite receiving sections. The opposite receiving sections are disposed for receiving wires of data lines. Thus it is possible to arrange the connecting element between two data lines for example of one cable, whereby the basic cylindrical structure of the cable is not basically changed. The opposite receiving sections may have a circular shape perpendicular to the longitudinal axis of the element. Thus, the receiving sections fit to circular cross sections of a cable with data lines.

In a further embodiment, the element is covered by an electromagnetic shielding, whereby the shielding is connected with a further electromagnetic shielding of the cable. Therefore, it is possible to provide a continuous electromagnetic shielding for the cable and the connecting element.

In a further embodiment, the element has a cross sectional area which is smaller or at most as large as the cross sectional area of the cable. Thus it is possible to integrate the connecting element in the cable without increasing the diameter of the cable in the area of the connecting element.

In a further embodiment, the conductors are arranged on opposite sides of the plate section. Thus, it is possible to provide an electrical connection between the circular-arranged data lines that are arranged below the plate section in a simple manner to the contact area that is disposed on a lower side of the plate section. The result is that for each conductor more surface on the plate section is available because also the lower side of the plate section is used for disposing conductors.

In a further embodiment, conductive layers are arranged in the recesses and the wires of the data lines are electrically connected to the conductive layers. The conductive layers are electrically connected to the conductors or are parts of the conductors.

In a further embodiment, the recesses are embodied as holes, whereby at least endings of the wires are arranged in the holes. By using the holes the fixing and the guiding of the data lines and the wires is more robust.

BRIEF DESCRIPTIONS OF THE DRAWINGS

Embodiments of the invention are described in the following Figures, in which.

Figure 1:
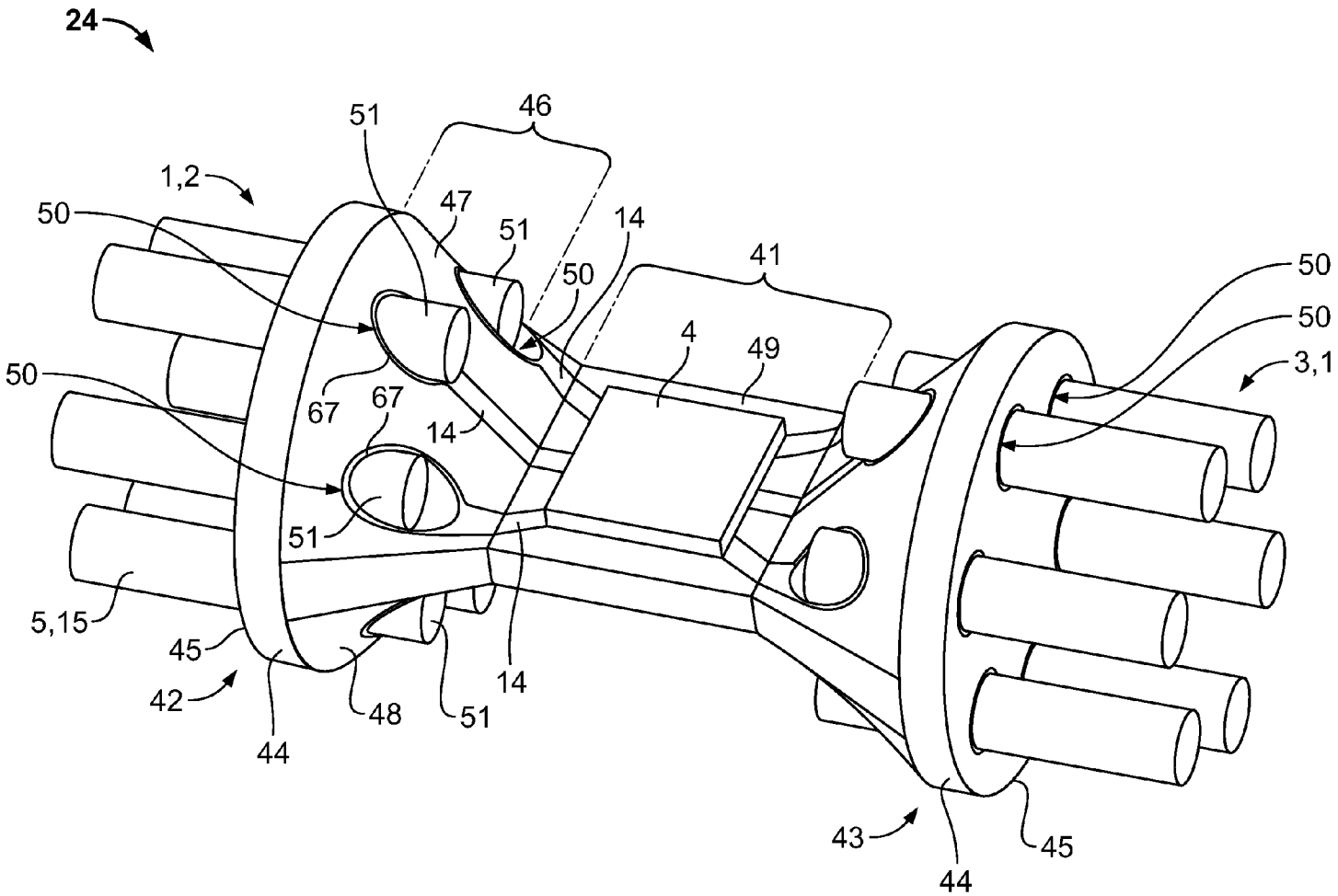
FIG. 1 shows a connecting element in a perspective view.

FIG. 1 depicts a connecting element 24 that is embodied as a carrier for an electronic or electric circuit for example a repeater unit. The repeater unit 4 is a signal-receiving, signal-equalizing and signal-amplifying circuit which is used to receive data signals from a first or second data line section 2, 3, amplifying the data signals and sending the amplified data signals to the second or the first data line section 3, 2. A basic function of the repeater unit 4 is to amplify the data signals which results in the possibility of transmitting data signals with a higher data transmission rate and/or to transmit data rate signals over a longer data line. The repeater unit may reshape the signal, re-time the signal or perform a combination of these functions on an analogue or digital signal.

DETAILED DESCRIPTION OF THE INVENTION

The connecting element 24 comprises a plate section 41 and two opposite receiving sections 42, 43. The first and second receiving sections 42, 43 are in this embodiment in an identical shape. Each of the receiving section 42, 43 comprises a circular shape perpendicular to a longitudinal axis of the connecting element. The circular shape 44 is limited by an end face 45 that is opposite to the plate section 41. A diameter of the first receiving section 42 starting from the circular shape 44 diminishes in an intersection region 46 in direction to the plate section 41. The intersection region 46 between the circular shape 44 and the plate section 41 is embodied as two opposite half conical planes 47, 48 that change over to the plate section 41. The plate section 41 is embodied as a rectangular plate, whereby on an upper side 49 a repeater unit 4 is fixed to the upper side 49 of the plate section 41. The first receiving section 42 comprises six holes 50 which are guided through the end face 45 in a longitudinal direction of the connecting element 24. The holes 50 may be arranged in a shape corresponding to an arrangement of data lines in a cable. The holes 50 are preferably arranged in a circular arrangement. Preferably, the holes 50 are uniformly distributed over a circle. Wires 15 of a first data line 5 of the first line section 2 of a cable 1 are guided via the end face 45 through the holes 50. Ends 51 of the wires 15 protrude through the first or second plane 47, 48.

On the surface of the first and second plane 47, 48 electrical conductors 14 are disposed which are guided from the holes 50 to a contact area where contacts of the repeater unit 4 are disposed. Depending on the used embodiment, at least a part of the hole 50 is covered with an electrical layer 67 that may be part of an electrical conductor 14 or that is connected with the electrical conductor 14. The ends 51 of the wires 15 are electrically connected to the electrical layer 67 or to the conductors 14 for example by soldering.

Depending on the used embodiment, the cross sectional area of the first and second receiving section 42, 43 may also have different shapes for example a rectangular shape and a circular shape. The shown connecting element 24 is only an example for one of several possible shapes.

Furthermore in FIG. 1 only an upper side of the plate section 41 can be seen. The lower side of the connecting element 24 can be identical to the upper side, whereby depending on the used embodiment, also on the lower side a further repeater unit 4 may be arranged or the conductors 14 of the lower side are guided via the plate section 41 to the upper side of the plate section 41 and connected with contacts of the repeater unit 4.

Furthermore, the arrangement of the holes 50 may change depending on the used embodiment. Instead of holes 50, recesses may be arranged that are open to a rim area of the circular shape 44.

Figure 2:
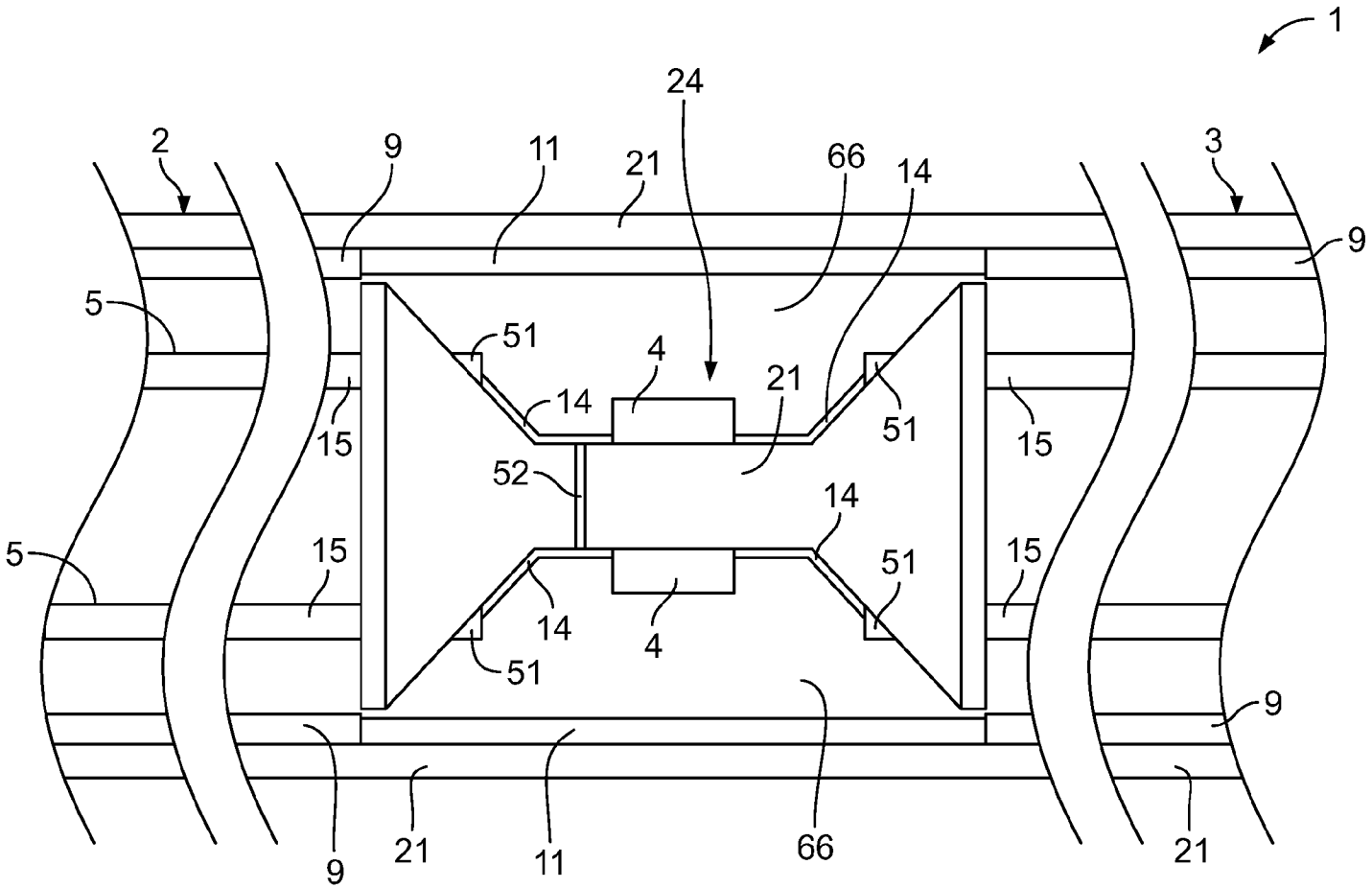
FIG. 2 shows the connecting element integrated in a cable.

FIG. 2 shows a schematic side view of the connecting element 24 that is integrated in a cable 1. In this embodiment, the connecting element 24 is in the area above and below the plate section 41 embedded in insulating material 66. Furthermore the embedded connecting element 24 comprises a shielding layer 11 that encompasses the connecting element 24. The shielding layer 11 may for example be embodied as a metallic sleeve or as a metallic net structure. The shielding layer 11 is connected with an electric shielding 9 of a first and second line section 2, 3 of the cable 1. The shielding layer 11 is covered by an insulating outer jacket 21 of the cable 1. The outer jacket 21 of the cable 1 may also be absent around the connecting element 24. In this embodiment, there might be a further electrically insulating cover that covers the shielding layer 11 and that is connected to the outer jackets 21 of the first and second line sections 2, 3 of the cable. In this embodiment, a further repeater unit 4 is arranged on the lower side of the plate section 41. In this embodiment, there is an electrical via conductor 52 which is guided through the plate section 41 from a conductor 14 that is disposed on the lower side to another conductor 14 that is arranged on the upper side of the plate section 41.

Figure 3:
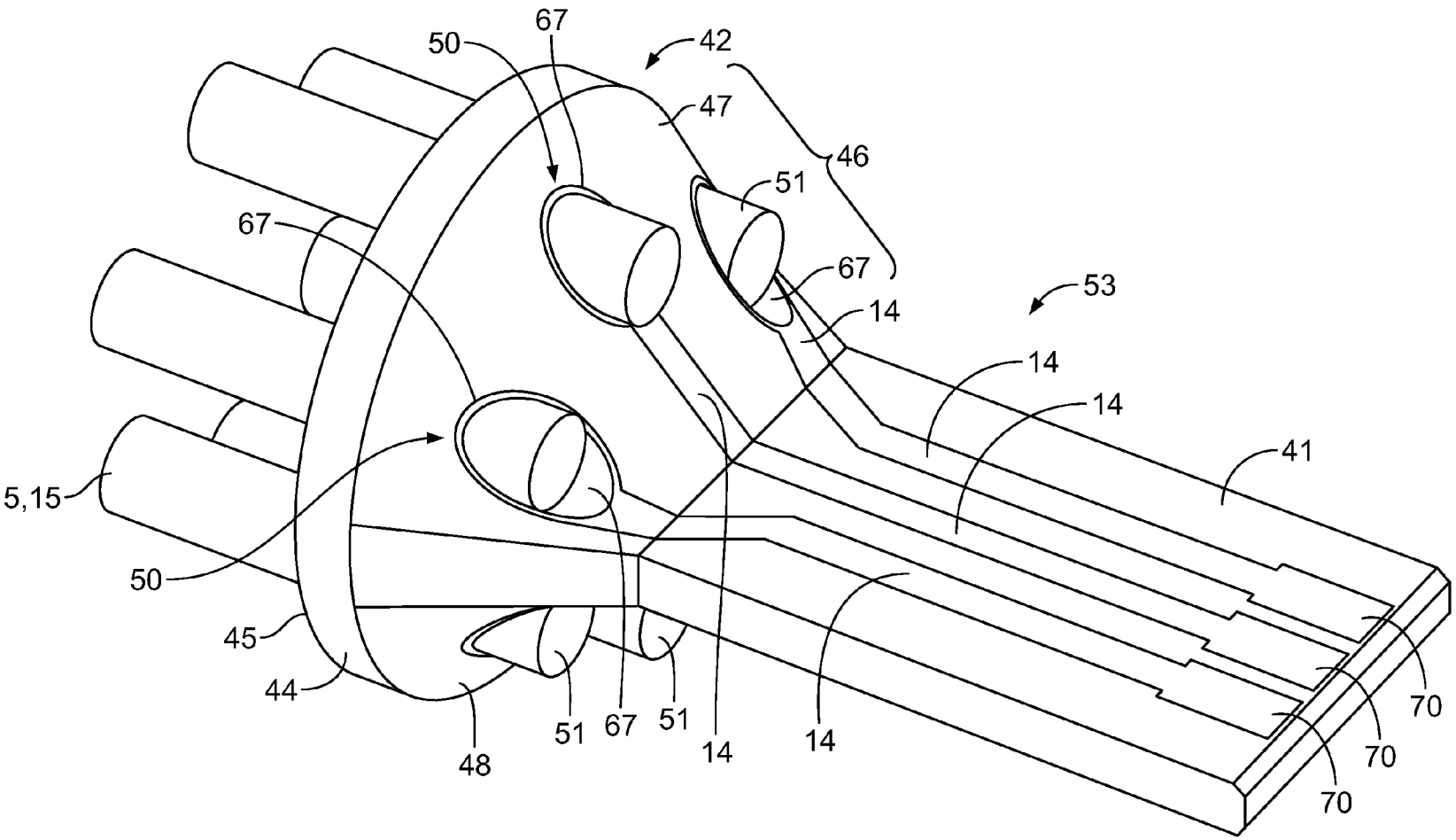
FIG. 3 shows a further embodiment of the connecting element.

FIG. 3 shows a further connecting element 53 that is embodied as a connector interface. The further connecting element 53 comprises a first receiving section 42 that is embodied in the same shape as for the connecting element 24 shown in FIG. 1. The first receiving section 42 merges in a plate section 41 that does not carry a repeater unit 4 but carries contacts 70 that are connected with the electrical conductors 14. The contacts 70 are embodied as contact fields that are used for connecting an electrical connection to another contact. In FIG. 3 only the upper side of the plate section 41 can be seen, but the lower side is embodied in the same manner.

Figure 4:
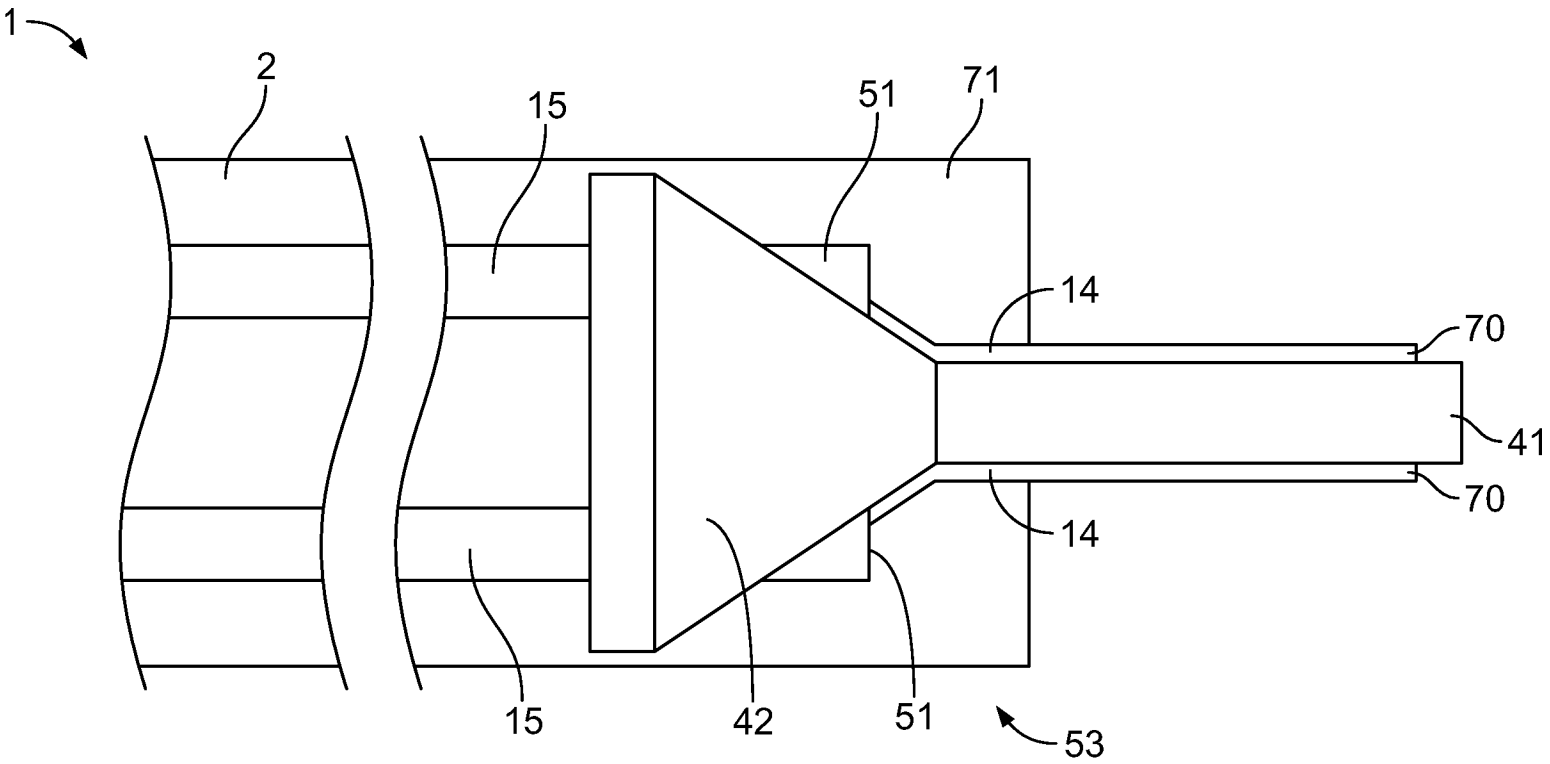
FIG. 4 shows a schematic view of the second connecting element connected to a cable.

FIG. 4 shows a further connecting element 53 that comprises a cover cap 71 and that is electrically connected to wires 15 of a first line section 2 of a cable 1. The first line section 2 is embodied in the same manner as described and shown in the FIGS. 1 and 2.

Figure 5:
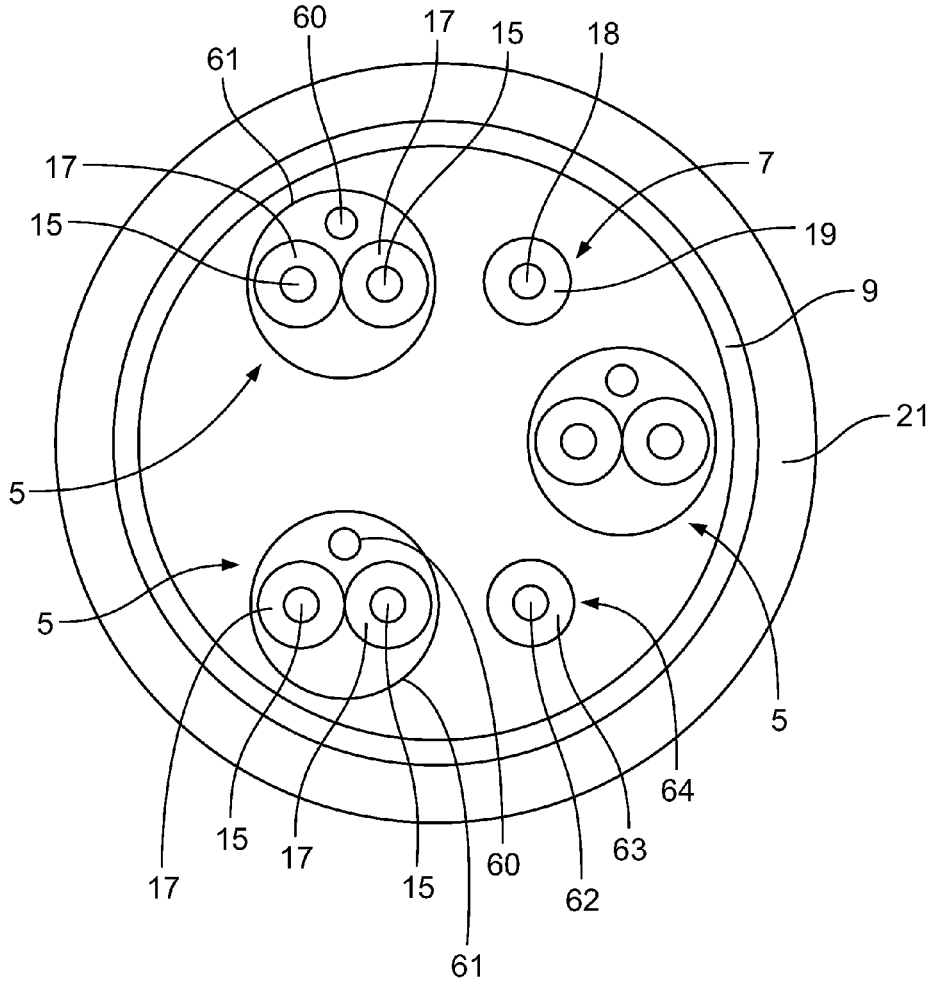
FIG. 5 shows a cross sectional view of a line section of a cable.

FIG. 5 depicts a cross sectional view through a first line section 2 of a cable 1. The second line section 3 is embodied in the same manner The first line section 2 comprises several first data lines 5. The shown first data line 5 is embodied as a twin-pair cable with pairs of wires 15, whereby each wire 15 is covered with an insulating layer 17. Furthermore, a drain wire 60 is arranged at the pair of insulated wires 15. The pair of wires 15 and the drain wire 60 are surrounded by a second electrical shielding 61. The drain wire 60 is an electrical conductor and is used as grounding and current return path. The wires 15 may be solid conductors or comprised of a plurality of smaller strands. The wires 15 may be made of copper or aluminum or copper-plated or -sheeted aluminum or the like. Depending on the used embodiment, the first data lines 5 may be embodied as a single insulated and electrical shielded wire 15.

The first line section 2 comprises the power line 7 with a power conductor 18 which is covered with a second insulating layer 19. The first data lines 5 and the power line 7 are encompassed by the electrical shielding 9. The shielding 9 has the shape of a braid and encompasses the first data lines 5 and the power line 7. The shielding 9 is covered with an outer jacket 21 which encompasses the shielding 9 and which is made of an insulating material. The outer jacket 21 disposes an insulating coating of the cable. Furthermore, there is a mass line 64 which comprises a mass conductor 62 which is covered by a third insulating layer 63. The mass line 64 is connected to a mass contact of the repeater 4.

Figure 6:
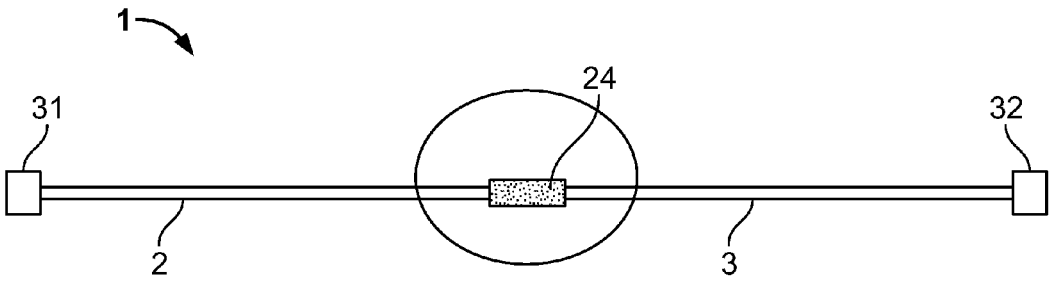
FIG. 6 shows a schematic view of a cable with the connecting element.

FIG. 6 depicts a schematic view of a cable 1 with an integrated connecting element 24, whereby endings of the cable 1 are connected to a first or respectively a second connector 31, 32.

The invention claimed is:

1. A connecting element for data lines, comprising:

a receiving section with recesses for receiving wires of the data lines, the recesses extending onto a plane of the receiving section, and a plate section connected with the receiving section, whereby electrical conductors are disposed on a surface of the receiving section plane, whereby the conductors are guided from the recesses on the receiving section to a contact area of the plate section, whereby the element is made of molded material.

2. The element of claim 1, whereby the recesses are arranged in a shape corresponding to an arrangement of data lines in a cable, whereby the recesses are preferably arranged in a circular arrangement.

3. The element of claim 1, whereby the wires are arranged in the recesses and electrically connected with the conductors.

4. The element of claim 1, whereby the receiving section has a circular shape perpendicular to a longitudinal axis of the element.

5. The element of claim 1, whereby the plate section is a connector interface.

6. The element of claim 1, whereby an electrical or electronic circuit is disposed on the plate section, and whereby the conductors are connected with contacts of the electrical or electronic circuit.

7. The element of claim 6, whereby a second receiving section for receiving wires of a further data line is connected with the plate section opposite to the first receiving section.

8. The element of claim 7, whereby the opposite receiving sections are connected with two data lines of a cable, and whereby the connecting element is integrated in the cable.

9. The element of claim 8, whereby the element is covered by an electromagnetic shielding, whereby the shielding is connected with a further electromagnetic shielding of the cable.

10. The element of claim 8, whereby a cross sectional area of the element is smaller or at most as large as a cross sectional area of the cable.

11. The element of claim 1, whereby the conductors are arranged on two opposite sides of the plate section.

12. The element of claim 1, whereby electrically conductive layers are arranged in the recesses and the wires are electrically connected with the layers.

13. The element of claim 12, whereby the recesses are embodied as holes.

14. A connecting element for data lines, comprising:

a receiving section with recesses for receiving wires of the data lines, whereby electrical conductors are disposed on the connecting element, a plate section connected with the receiving section, the conductors being guided from the recesses on the receiving section to a contact area of the plate section, the element is made of molded material, and an electrical or electronic circuit is disposed on the plate section, and whereby the conductors are connected with contacts of the electrical or electronic circuit.

15. The element of claim 14, whereby the recesses are arranged in a shape corresponding to an arrangement of data lines in a cable, whereby the recesses are preferably arranged in a circular arrangement.

16. The element of claim 14, whereby the wires are arranged in the recesses and electrically connected with the conductors.

17. The element of claim 14, whereby the receiving section has a circular shape perpendicular to a longitudinal axis of the element.

18. The element of claim 14, whereby the plate section is a connector interface.

19. The element of claim 18, whereby a second receiving section for receiving wires of a further data line is connected with the plate section opposite to the first receiving section.

20. The element of claim 19, whereby the opposite receiving sections are connected with two data lines of a cable, and whereby the connecting element is integrated in the cable.

21. The element of claim 19, whereby the element is covered by an electromagnetic shielding, whereby the shielding is connected with a further electromagnetic shielding of the cable.

22. The element of claim 19, whereby a cross sectional area of the element is smaller or at most as large as a cross sectional area of the cable.

23. The element of claim 14, whereby the conductors are arranged on two opposite sides of the plate section.

24. The element of claim 14, whereby electrically conductive layers are arranged in the recesses and the wires are electrically connected with the layers.

25. The element of claim 24, whereby the recesses are embodied as holes.

26. A connecting element for data lines, comprising:

a receiving section with recesses for receiving wires of the data lines, whereby electrical conductors are disposed on the connecting element, a plate section connected with the receiving section, the conductors being guided from the recesses on the receiving section to a contact area of the plate section, the element is made of molded material, and the conductors are arranged on two opposite sides of the plate section.

27. The element of claim 26, whereby the recesses are arranged in a shape corresponding to an arrangement of data lines in a cable, whereby the recesses are preferably arranged in a circular arrangement.

28. The element of claim 26, whereby the wires are arranged in the recesses and electrically connected with the conductors.

29. The element of claim 26, whereby the receiving section has a circular shape perpendicular to a longitudinal axis of the element.

30. The element of claim 26, whereby the plate section is a connector interface.

31. The element of claim 30, whereby a second receiving section for receiving wires of a further data line is connected with the plate section opposite to the first receiving section.

32. The element of claim 31, whereby the opposite receiving sections are connected with two data lines of a cable, and whereby the connecting element is integrated in the cable.

33. The element of claim 31, whereby the element is covered by an electromagnetic shielding, whereby the shielding is connected with a further electromagnetic shielding of the cable.

34. The element of claim 31, whereby a cross sectional area of the element is smaller or at most as large as a cross sectional area of the cable.

35. The element of claim 26, whereby electrically conductive layers are arranged in the recesses and the wires are electrically connected with the layers.

36. The element of claim 35, whereby the recesses are embodied as holes.

37. The element of claim 26, further comprising an electrical or electronic circuit disposed on the plate section, and whereby the conductors are connected with contacts of the electrical or electronic circuit.

* * * * *